US008495980B2

(12) United States Patent
Scherzinger et al.

(10) Patent No.: US 8,495,980 B2
(45) Date of Patent: Jul. 30, 2013

(54) ADJUSTABLE CAMSHAFT ARRANGEMENT

(75) Inventors: Guido Scherzinger, Sax (CH); Bernd Mann, Zschopau (DE); Gunther Martin Lugauer, Feldkirch (AU); Mario Wolfinger, Triesenberg (LI); Frank Altag, Klein Denkte (DE); Peter Wiesner, Mauren (LI); Juergen Meusel, Dittmannsdorf (DE); Manfred Muster, Ludesch (AU); Alex Meier, Triesen (LI)

(73) Assignee: ThyssenKrupp Presta TecCenter AG, Eschen (LI)

( * ) Notice: Subject to any disclaimer, the term of this patent is extended or adjusted under 35 U.S.C. 154(b) by 359 days.

(21) Appl. No.: 12/994,651

(22) PCT Filed: May 4, 2009

(86) PCT No.: PCT/EP2009/003173

§ 371 (c)(1),
(2), (4) Date: Feb. 2, 2011

(87) PCT Pub. No.: WO2009/143950

PCT Pub. Date: Dec. 3, 2009

(65) Prior Publication Data

US 2011/0120401 A1 May 26, 2011

(30) Foreign Application Priority Data

May 29, 2008 (DE) ..... 10 2008 025 781

(51) Int. Cl.
*F01L 1/04* (2006.01)

(52) U.S. Cl.
USPC ..... 123/90.6; 123/90.17

(58) Field of Classification Search
USPC ..... 123/90.17, 90.6; 74/567; 29/888.1
See application file for complete search history.

(56) References Cited

U.S. PATENT DOCUMENTS 4,332,222 A 6/1982 Papez
5,009,123 A 4/1991 Hiraoka et al.

(Continued)

FOREIGN PATENT DOCUMENTS

DE 28 22 147 A1 11/1979
DE 197 57 504 A1 7/1999

(Continued)

OTHER PUBLICATIONS

Form PCT/ISA/237 dated Dec. 6, 2010 (six (6) pages).

(Continued)

*Primary Examiner* — Thomas Denion
*Assistant Examiner* — Daniel Bernstein
(74) *Attorney, Agent, or Firm* — Crowell & Moring LLP

(57) ABSTRACT

A camshaft arrangement for a motor vehicle engine has a hollow outer shaft and an inner shaft supporting inner shaft cams. The inner shaft cams are non-rotatably attached to the inner shaft by at least one connection element that protrudes with clearance through an aperture in the outer shaft and is attached to the respective inner shaft cam which is rotatably mounted on the outer shaft. When inserted into a receiver in the inner shaft, a portion of the connection element protrudes out of the receiver, and the protruding portion is at least partially inserted into an aperture located at the joint diameter of the inner shaft cam. This aperture is open at least towards an end face of the inner shaft cam. The protruding portion has at least two opposite-lying side surfaces lying with an interference fit against corresponding inner surfaces of the aperture of the inner shaft cam.

17 Claims, 10 Drawing Sheets

U.S. PATENT DOCUMENTS

| | | | | |
|---|---|---|---|---|
| 5,724,860 | A | 3/1998 | Sekiguchi et al. | |
| 5,729,899 | A | 3/1998 | Kaywood et al. | |
| 7,431,002 | B2 * | 10/2008 | Hoffmann et al. | 123/90.6 |
| 7,597,078 | B2 * | 10/2009 | Kroos et al. | 123/90.6 |
| 7,610,890 | B2 * | 11/2009 | Lettmann et al. | 123/90.6 |
| 7,958,859 | B2 * | 6/2011 | Methley et al. | 123/90.6 |
| 2006/0174724 | A1 | 8/2006 | Hoffmann et al. | |

FOREIGN PATENT DOCUMENTS

| | | | |
|---|---|---|---|
| DE | 299 22 876 | U1 | 6/2000 |
| DE | 10 2005 004 976 | A1 | 8/2006 |
| EP | 1 362 986 | A1 | 11/2003 |
| EP | 1 696 107 | A1 | 8/2006 |
| GB | 2 424 256 | A | 9/2006 |

OTHER PUBLICATIONS

Corresponding International Search Report (Form PCT/ISA/210) dated Aug. 19, 2009 with English translation, along with Form PCT/ISA/237 (Ten (10) pages).

* cited by examiner

ADJUSTABLE CAMSHAFT ARRANGEMENT

CROSS-REFERENCE TO RELATED APPLICATIONS

This application is a national stage application of PCT International Application No. EP 2009/003173, filed May 4, 2009, and claims priority under 35 U.S.C. §119 to German Patent Application No. 10 2008 025 781.8, filed May 29, 2008, the entire disclosures of the aforementioned documents are herein expressly incorporated by reference.

BACKGROUND AND SUMMARY OF THE INVENTION

Exemplary embodiments of the present invention relate to a camshaft arrangement for a driving mechanism, in particular for a motor vehicle engine. The camshaft arrangement has two shafts disposed coaxially one inside the other, wherein a hollow outer shaft and an inner shaft are disposed so as to be able to rotate with respect to each other. The two shafts each support a plurality of cams, wherein the outer shaft cams supported by the outer shaft are non-rotatably attached to the outer shaft, while the inner shaft cams supported by the inner shaft are non-rotatably attached to the inner shaft. If the inner shaft and outer shaft are rotated oppositely to each other, the cams are adjusted with respect to each other.

Such adjustable camshaft arrangements are increasingly being used in valve-controlled internal combustion engines to influence the control times of the valves of the engine in a targeted manner with respect to output and torque generation, fuel consumption and exhaust gas emission. These camshaft arrangements are, for example, built-up camshaft systems with an outer shaft and an inner shaft disposed coaxially therein. The two shafts can be rotated with respect to each other using an adjustment device. Cam elements which are alternately fixedly connected to the outer shaft and mounted so as to be able to rotate about the outer shaft are disposed on the outer shaft. The rotatably mounted cam elements are fixedly attached to the inner shaft but can rotate relative to the outer shaft by a defined circumferential angle. This is achieved, for example, by the inner shaft cam elements being fixedly connected to the inner shaft using a connection element, wherein this connection element protrudes with clearance through an aperture in the outer shaft, which enables rotation of the inner shaft and therefore of the inner shaft cams by the defined circumferential angle.

The rotation of the inner shaft with respect to the outer shaft is effected, for example, using a phase shifter which permits an adjustment of the outer shaft cams fixedly connected to the outer shaft with respect to the inner shaft cams fixedly connected to the inner shaft or vice versa, in order thus to achieve a phase shift of the valve control times.

In order to produce a fixed connection between the inner shaft and the associated inner shaft cam elements, these cams and the inner shaft conventionally have bores, into which corresponding connection elements are inserted. These can be pins, bolts or screws. The cam elements can be appropriately designed to permit insertion of a connection element.

German laid-open document DE 197 57 504 A1, for example, discloses for this purpose a camshaft with such a connection element in the form of a cylindrical pin. The cylindrical pin is inserted with a press fit into a through-bore in the inner shaft and with a clearance fit into the associated cam. The cam has for this purpose an outwardly-located cylindrical region in which a bore is located, into which the cylindrical pin is inserted. The cylindrical region is intended to ensure that the bore is located away from the contact surface of the cam in order in this way to produce an uninterrupted contact surface between the cam and the outer shaft.

Furthermore, German laid-open document DE 10 2005 004 976 A1 discloses a camshaft with cams which can be rotated oppositely to each other, in which a connection element is designed in two parts. A first part of the connection element is hollow and protrudes into a radial bore in the inner shaft. A second connection part is inserted into the hollow first connection part from the other side in such a way that it expands and an interference fit is produced. The two connection parts can also be designed, for example, as a screw with a complementary threaded bore.

European patent EP 1 362 986 B1 also discloses the mounting of an adjustable camshaft arrangement in which a hollow coupling pin is guided with a narrow fit into a bore in both the inner shaft and the outer shaft as well as into a cam. The outer diameter of the coupling pin is then enlarged by insertion of an inner pin in order to produce a press fit.

German patent DE 28 22 147 C3 further discloses a camshaft arrangement in which the connection between the inner shaft and cam is effected via an entrainer, which is attached to the inner shaft with a screw. The outer shaft has an aperture for passage of the entrainer. The entrainer further protrudes into an inner groove which is located at the joint diameter of the associated cam. The cam is pushed with the groove onto the entrainer from the side and secured in its axial position on the right and left with rings.

If the connection between the inner shaft cams and the inner shaft is arranged as a fixed connection owing to the alternating camshaft loading, a press fit of the connection elements is expediently employed both in the cam and also in the inner shaft. This is disadvantageous in the known connection elements, which have a constant cross-section in that the cross-section of the connection element required to achieve the press fit must be joined via a plurality of component bores in the cam and inner shaft. This can lead to undefined influencing of the pressing overlap, and therefore of the security of the press connection. In particular, joint connections of this type can lack sufficient connection firmness.

Exemplary embodiments of the present invention provide a built-up camshaft arrangement which is easy to fit together and offers secure connection with sufficient firmness between the inner shaft and inner shaft cam.

This object is achieved in accordance with the invention by a camshaft arrangement A camshaft arrangement for a motor vehicle engine, comprising a hollow outer shaft supporting a plurality of outer shaft cams, wherein the outer shaft cams are non-rotatably attached to the outer shaft and an inner shaft disposed coaxially inside the outer shaft, wherein the hollow outer shaft and the inner shaft are disposed so as to be able to rotate with respect to each other, and wherein the inner shaft supports a plurality of inner shaft cams that are each non-rotatably attached to the inner shaft by at least one connection element. The at least one connection element protrudes with clearance through an aperture in the outer shaft and is attached to one of the plurality of inner shaft cams that is rotatably mounted on the outer shaft and the at least one connection element is inserted into a receiver in the inner shaft so that a portion of the connection element protrudes out of the receiver, and the protruding portion is at least partially inserted into an aperture located at a joint diameter of the one of the plurality of inner shaft cams, wherein the aperture is open at least towards an end face of the one of the plurality of inner shaft cams, and the protruding portion has at least two opposite-lying side surfaces that lie with an interference fit against two corresponding inner surfaces of the aperture of the one of the plurality of inner shaft cams.

The camshaft arrangement according to the present invention involves a respective connection element that is inserted into a receiver in the inner shaft in such a way that a portion of the connection element protrudes out of the receiver, and that the protruding portion is at least partially inserted into an aperture which is located at the joint diameter of the respective inner shaft cam. This aperture is open at least towards an end face of the inner shaft cam, and the protruding portion has at least two opposite-lying side surfaces which lie with an interference fit against two corresponding inner surfaces of the aperture of the respective inner shaft cam.

In one aspect of the present invention the connection element is a feather key, and the receiver in the inner shaft is formed as a feather key receiver. In another aspect of the present invention the connection element has a stem and a head portion, wherein the stem is inserted into a receiver in the inner shaft, while the head portion is inserted at least partially into an aperture which is located at the joint diameter of the respective inner shaft cam. This aperture is open at least towards an end face of the inner shaft cam, and the head portion has at least two opposite-lying side surfaces that lie with an interference fit against two corresponding inner surfaces of the aperture of the respective inner shaft cam. Using the aperture that is open towards the end face of the inner shaft cam, the inner shaft cam can be pressed onto the head portion of the connection element in parallel with the longitudinal axis of the camshaft. In this way, the two interference fits of the stem/inner shaft and head portion/inner shaft cam cannot influence each other and the two interference fits can be produced reliably and with sufficient connecting firmness.

The connection element can have a stem and a head portion, wherein the stem is inserted with an interference fit into the receiver, while the head portion is at least one component of the protruding portion of the connection element. In one aspect of the present invention the head portion of the connection element is located completely outside the outer shaft. Alternatively, however, a head portion can also be located only partially within the aperture in the respective inner shaft cam and partially within the aperture in the outer shaft.

Furthermore, the head portion can also be located partially in the receiver in the inner shaft, extend through the aperture in the outer shaft and then into the aperture in the inner shaft cam. In this case the inner shaft can have a stepped bore as the receiver, into which the head portion of the connection element partially protrudes, while the lower region of the bore receives the stem of the connection element. This stepped bore is formed, for example, as a stepped cylindrical bore with two diameters. The larger, externally disposed diameter receives a portion of the head portion of the connection element. The portion of the head portion disposed in this widened portion of the stepped bore is adapted to the diameter of the widened region of the stepped bore so that a cylindrical head portion has a larger cross-section in this region. Thus, the loading of the connection element in this critical region is reduced because the increase in cross-section reduces the effective tension. The surface pressure in the contact region between the inner shaft and the head portion in the widened region of the stepped bore is also clearly reduced.

As an alternative to a stepped bore, a stepped aperture can also be provided as a receiver in the inner shaft. In contrast to a stepped bore with at least two cylindrical portions of different diameters, this stepped aperture has a cylindrical portion, in which the stem of the connection element is disposed with an interference fit, and a non-cylindrical portion which receives the non-cylindrical head portion. The non-cylindrical form advantageously ensures that a precisely positioned alignment of the head portion relative to the longitudinal axis of the camshaft arrangement is rendered possible so that the inner shaft cam can be placed precisely in the correct desired position. At the same time, the stem of the connection element can be cylindrical and inserted in a simple manner into the cylindrical portion of the stepped aperture. If the non-cylindrical portion of the stepped aperture is formed in such a way that the cross-section of this portion is larger than that of the cylindrical portion then, in addition to the advantage of the exact alignment of the head portion of the connection element, the advantages mentioned above in relation to the stepped bore, concerning a reduction in the tensions in the critical component region and a reduction in the surface pressure in the contact region between the inner shaft and head portion, are achieved.

Furthermore, the stem of the connection element can extend through the body of the inner shaft and into a second aperture in the outer shaft. An inner shaft cam can also be connected to the inner shaft by two opposite-lying connection elements in such a way that a torque transfer is ensured. The stems of two connection elements can also be inserted into a common receiver in the inner shaft.

The aperture can extend for passage of the connection element through the outer shaft over a portion of the circumference of the outer shaft in such a way that a movement of the connection element and therefore of the inner shaft relative to the outer shaft by an adjustment angle $\alpha$ is possible.

The head portion of a connection element can be formed at right angles to the stem portion of the connection element. Furthermore, the two side surfaces of the head portion and the two inner surfaces of the aperture can each extend in parallel or conically with respect to each other in order to make it easier for the connection part to be pushed into the aperture or for the inner shaft cam to be pushed onto the head portion and in order to produce a press fit. The two side surfaces of the head portion and/or the two inner surfaces of the aperture in the inner shaft cam can also have a profiled surface.

In both aspects of the present invention the aperture in the inner shaft cam can be formed as a groove extending over the whole width of the inner shaft cam. This aperture can be centrally located below the elevation of the inner shaft cam, and the connection element is preferably formed as a single-piece component.

One advantage of the first aspect of the present invention in which a feather key is inserted as a connection element is to be found in the fact that feather keys are inexpensive mass-produced components which are readily available. The feather key connection technique has been well mastered in terms of manufacturing technology. Furthermore, the whole cam width, i.e. the cam thickness in the axial direction, of the inner shaft cam for the formation of the press fit between the feather key and inner shaft cam can be used, whereby a particularly large joint surface for the formation of the pressing connection between the inner shaft cam and connection element is provided. This produces a particularly firm connection, whereby the radial construction height of the inner shaft cam is minimised in turn, which makes possible a saving in construction space and weight. This embodiment of the camshaft arrangement in accordance with the invention with a feather key can therefore be used in a particularly advantageous manner in smaller passenger car camshafts.

A further advantage of the present invention, and in particular of the second aspect of the camshaft arrangement in accordance with the invention, is in the fact that the cross-section of the connection element for the required interference fit of the connection between the connection element and the inner shaft or between the connection element and the inner shaft cam does not have to be joined over the whole connection element. Instead, an interference fit for the connection between the connection element and inner shaft is produced over the cross-section of the stem and, separate therefrom, over the side surfaces of the head portion an interference fit for the connection between the connection element and inner shaft cam is produced. This leads to an increased level of security in the respective interference fits.

Furthermore, an inner shaft cam is connectable in a simple manner to the inner shaft in that initially the connection element is inserted into the inner shaft and the inner shaft cam is then pushed onto the head portion of the connection element from the side.

BRIEF DESCRIPTION OF THE DRAWING FIGURES

Further advantages, characteristics and expedient developments of the invention are given by the subordinate claims and the following presentation of preferred exemplified embodiments with the aid of the drawings in which:

DETAILED DESCRIPTION OF THE DRAWING FIGURES

Figure 1:
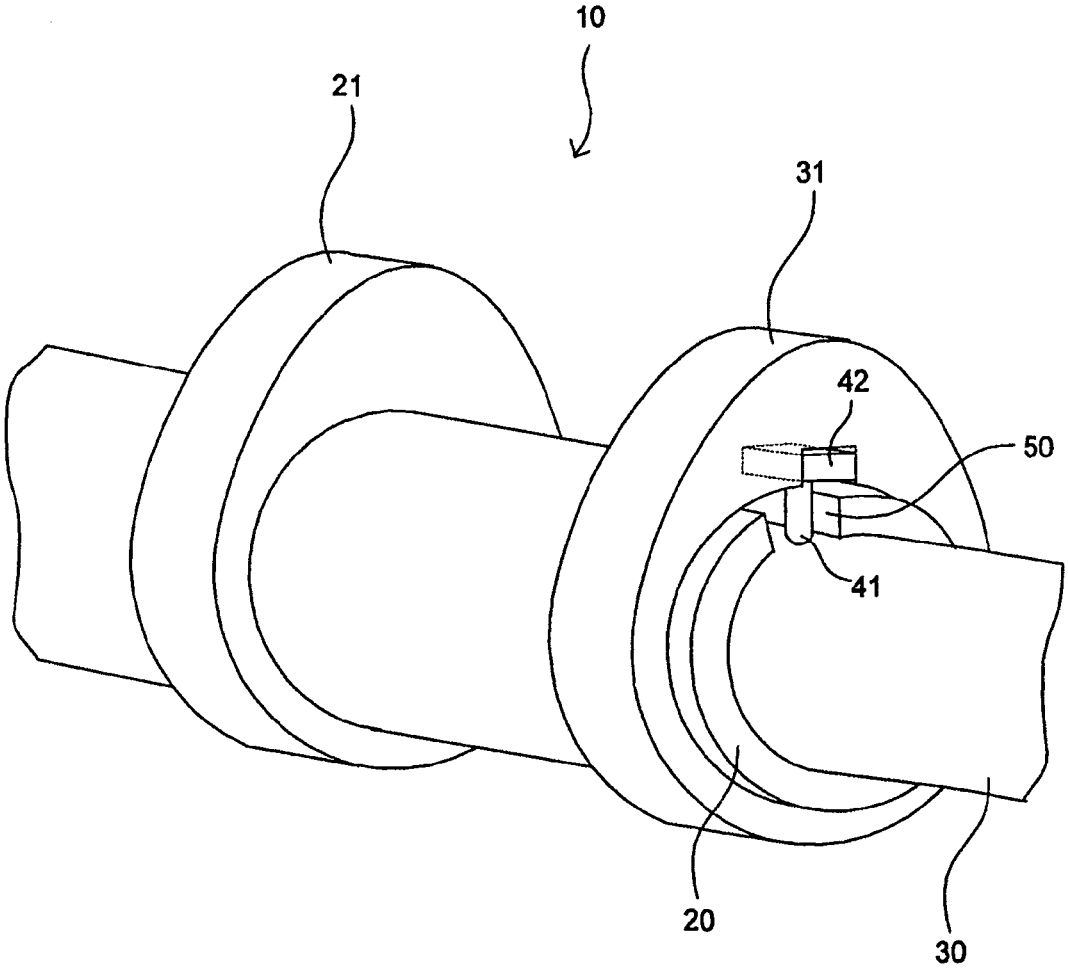
FIG. 1 shows an exemplified embodiment of the camshaft arrangement in accordance with the invention with a connection element.

FIG. 1 schematically shows an exemplified embodiment of a generic camshaft arrangement 10 in which an inner shaft 30 is disposed coaxially in an outer shaft 20, wherein the shaft bodies are shown shortened. The two shafts are mounted so that they can be rotated with respect to each other using bearings which are also not shown. The adjustment of the two shafts with respect to each other by an angle of rotation $\alpha$ can take place, for example, using an adjustment device, also not shown, in the form of a phase shifter. The inner shaft can be formed as a solid or hollow shaft, wherein in the FIGS. 1-8 a solid shaft is illustrated as a non-limiting example.

A plurality of outer shaft cams 21 are attached to the outer surface of the outer shaft 20 in a non-rotatable manner. The attachment of these outer shaft cam elements can be effected in a known manner, for example, by shrink-fitting, wherein a press fit is produced. For this purpose the joint diameter of the cam is selected in such a way that, at ambient temperature, it is smaller than the outer diameter of the outer shaft by a certain "overlap". If the cam element is heated, the inner diameter widens and the cam element can be threaded onto the outer shaft and positioned. Furthermore, provision can be made for the surface of the outer shaft to be previously worked or treated in the region of the cam. For example, profiling can be provided. Furthermore, the outer shaft can additionally be cooled in order to achieve a reduction in the diameter of the outer shaft. Intermediate elements, such as bushings, may be provided between the outer shaft and the respective cam element. When the cam element is being cooled the cam is shrunk on the shaft, wherein the overlap prevents a movement of the cam on the outer shaft.

As an alternative to such shrink-fitting of the cam elements, however, any suitable processes can be used for non-rotational attachment of the cams 21 to the outer shaft 20. For example, the outer shaft cams can be welded onto the outer shaft, or, in the regions in which the cams are to be attached, a plurality of webs or beads produced by material displacement are created by rolling machining tools. The cams are provided, for example, with a chamfered inner aperture and are pushed with this aperture over the beads. These are deformed in the outer region, and therefore crimped into the aperture, whereby the cam is held in a positive and non-positive locking manner on the outer shaft.

The outer shaft 20 also supports a plurality of inner shaft cams 31 which are rotatably mounted on the outer shaft but non-rotatably connected to the inner shaft 30. Between the inner diameter of the inner shaft cam elements 31 and the outer diameter of the outer shaft 20 clearance is, therefore, provided in order to permit rotation of the inner shaft cams 31 about the longitudinal axis of the camshaft arrangement.

In accordance with the invention the inner shaft cams 31 are fixedly connected to the inner shaft 30 by a pin-like connection element, as schematically illustrated in FIG. 1. The connection element can include a stem 41 and a head portion 42. The stem 41 of the connection element is inserted with a press fit into a bore in the inner shaft 30, while the head portion is inserted with a press fit into a groove in the inner shaft cam element 31. Between the bore and the stem 41, or between the groove and the head portion 42 there is a corresponding dimensional overlap in order to ensure an interference fit. The shape of the head portion 42 is adapted to the shape of the groove 32 or vice versa. The two interference fits are independent of each other.

Figure 2:
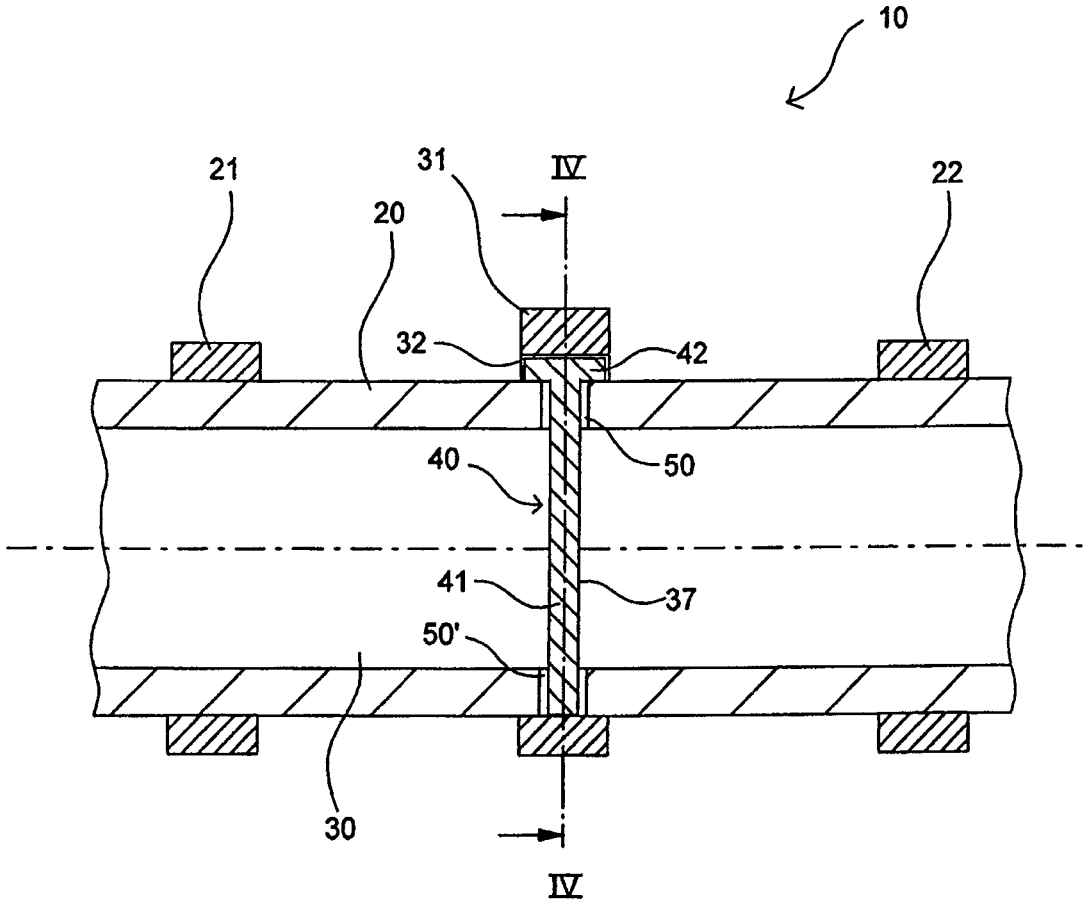
FIG. 2 shows an exemplified embodiment of the camshaft arrangement in accordance with the invention in a longitudinal cross-sectional view.

FIG. 2 shows a longitudinal cross-sectional view through an embodiment of the camshaft arrangement in accordance with the invention with a through-going connection element 40. The connection element comprising a stem 41 and head portion 42 can be formed as one piece. A stem portion 41 and a head portion 42, however, can also be joined together to form a two-piece connection element. This connection can be effected, for example, using a screw or pin connection. The stem 41 can have a circular, rectangular or other geometric stem cross-section which is adapted to the cross-section of the associated receiver in the inner shaft 30. A round stem cross-section, for example, has the advantage that the stem 41 and the associated bore 37 in the inner shaft 30 can be more easily produced than in the case of other stem cross-sections. However, because the position of the head portion 42 must be aligned in relation to the groove 32 in the inner shaft cam 31, rectangular or differently formed stem cross-sections have the advantage that a defined alignment of the head portion 42 of a connection element can be effected even during insertion of the stem into the inner shaft 30.

The head portion 42 can be formed at a right angle to the stem 41 and can be a cuboid, for example. Therefore, the connection element 40 is enlarged in the upwards direction by the head portion. However, provision can also be made for the head portion to be smaller than the stem and, for example, to be attached as a cuboid to the upper surface of a pin. In each case the head portion 42 always has at least two side surfaces 43 and 44 (cf. FIG. 5) which extend in parallel or conically with respect to each other. These side surfaces 43 and 44 of the head portion 42 can include profiling. The side surfaces 43 and 44 of the head portion 42 of the connection element 40 lie with an interference fit against the inner surfaces 34 and 35 of the groove 32 in order in this way to produce a firm connection (cf. FIG. 5).

In the exemplified embodiment of the invention shown in the figures, in which the connection element has a stem and a head portion, the stem 41 has a round cross-section, while the head portion 42 formed at a right angle to this stem is cuboidal and positioned on the end of the stem. When the built-up camshaft arrangement 10 is in the mounted condition, the stem 41 of the connection element 40 is inserted into a radial receiver 37 in the inner shaft 30. This receiver 37 is, for example, a round bore that is introduced radially into the material of the inner shaft 30. The round stem 41 of the connection element 40 can be inserted with a press fit into this bore 37.

An aperture 50 is provided in the outer shaft 20 to permit the connection element 40 to protrude through from the inner shaft 30 to the inner shaft cam element 31. The connection element 40 is passed through the aperture 50, and the head portion 42 of the connection element is inserted into an aperture 32 at the joint diameter of the inner shaft cam 31. The aperture 32 can be a groove that extends in the direction of the axis of the camshaft arrangement 10 and is open at least towards an end face of the inner shaft cam 31. In the exemplified embodiment illustrated in the figures, a through-groove 32 is provided which is easier to produce and which has two parallel or conically tapering inner surfaces 34 and 35. These inner surfaces can be provided with profiling in the same way as the side surfaces of the head portion 42 of the connection element 40.

The exemplified embodiments of FIGS. 4-8 show that the groove 32 can be located centrally below the elevation 36 of the cam 31. However, it can also be disposed offset with respect thereto if the material thickness of the cam allows this.

Figure 3:
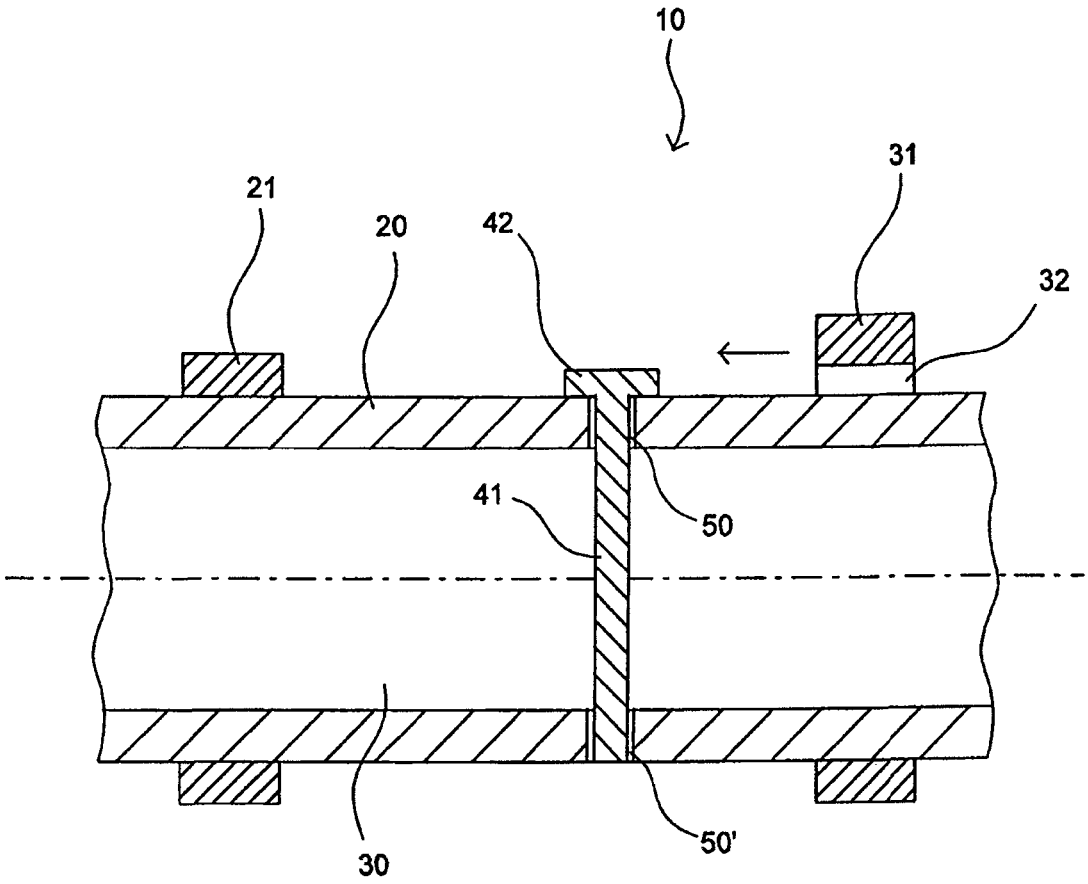
FIG. 3 shows a longitudinal cross-sectional view through a camshaft arrangement in accordance with FIG. 2 with a mounted connection element before mounting of an inner shaft cam element.

For the purpose of mounting the inner shaft cams 31, the stem 41 of a respective connection element 40 is inserted with an interference fit into the associated bore 37 in the inner shaft. The associated head portion 42 is aligned in the direction of the camshaft axis in such a way that an inner shaft cam 31 is threaded onto the outer shaft 20 and pushed with its groove 32 from the side onto the head portion 42 protruding over the outer shaft 20 and can be joined with a press fit into the groove 32. This is shown in FIG. 3, wherein the mechanical joining process can be supplemented by conventional joining processes such as shrink-fitting. If the side surfaces 43 and 44 of the head portion 42 and the inner surfaces 34 and 35 of the groove 32 extend conically with respect to each other, the inner shaft cam 31 is pushed over the head portion in such a way that the shape of the head portion 40 coincides with the shape of the groove 32.

Figure 4:
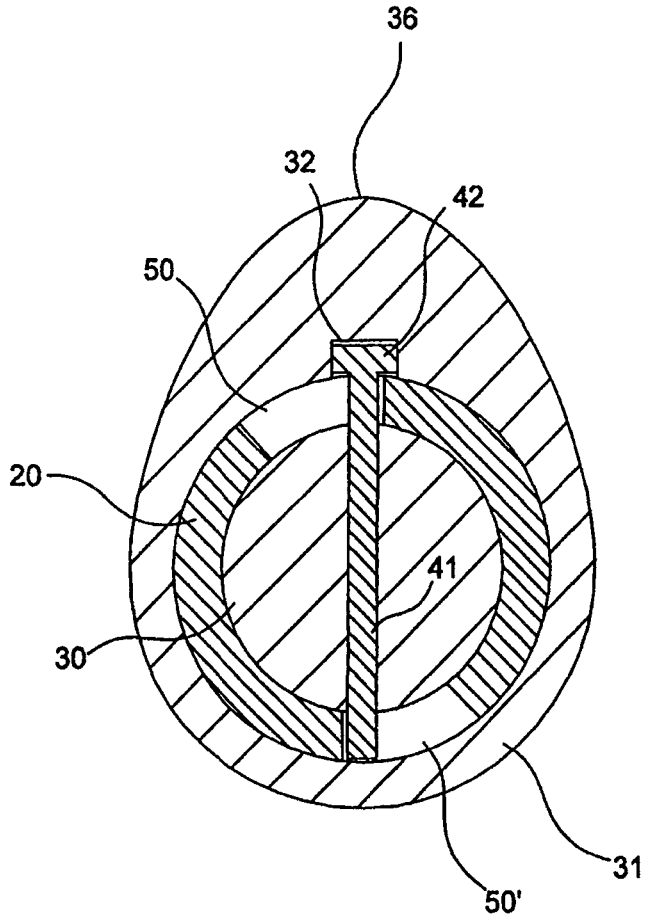
FIG. 4 shows a cross-sectional view through an exemplified embodiment of the camshaft arrangement in accordance with the invention with a through-going connection element.

In FIGS. 2 and 3 the connection element 40 is a through-going component that protrudes through a through-bore in the inner shaft 30 and into a second aperture 50' in the outer shaft. The cross-section of this exemplified embodiment in FIG. 4 shows that the two apertures 50 and 50' in the outer shaft 20 permit a rotation of the inner shaft 30 within the outer shaft. The apertures 50 and 50' define a maximum possible angle of rotation $\alpha$ of the inner shaft 30 with respect to the outer shaft 20 or vice versa.

Figure 5:
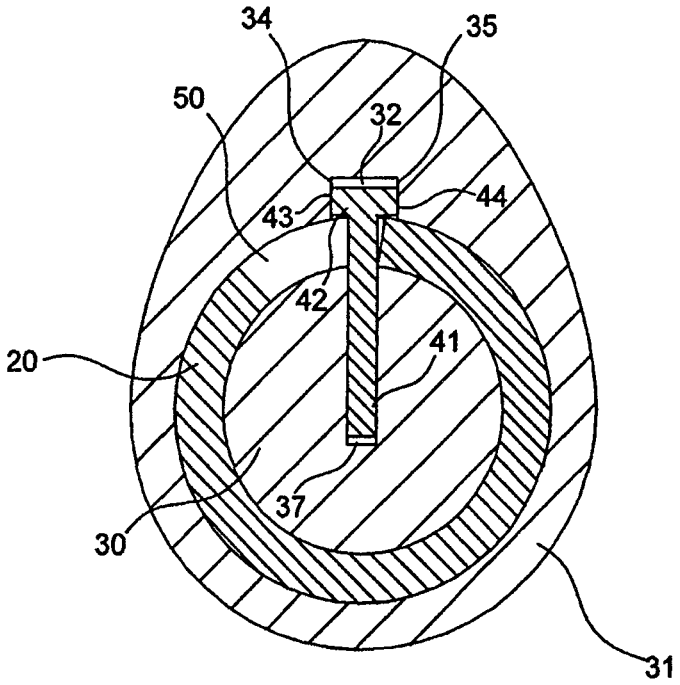
FIG. 5 shows a cross-sectional view through an exemplified embodiment of the camshaft arrangement in accordance with the invention with a short connection element.

In the exemplified embodiment of FIG. 5 the connection element 40 does not protrude through a through-bore in the inner shaft 30 into an aperture 50 in the outer shaft 20 but is in fact a shorter connection pin which is inserted into a blind hole. Accordingly, only one aperture 50 in the outer shaft 20 is required for a rotation of the inner shaft 30 with respect to the outer shaft 20. The connection element 40 can be of any length and, in a further exemplified embodiment, can also protrude, for example, completely through the inner shaft 30 but not into the outer shaft 20.

Figure 6:
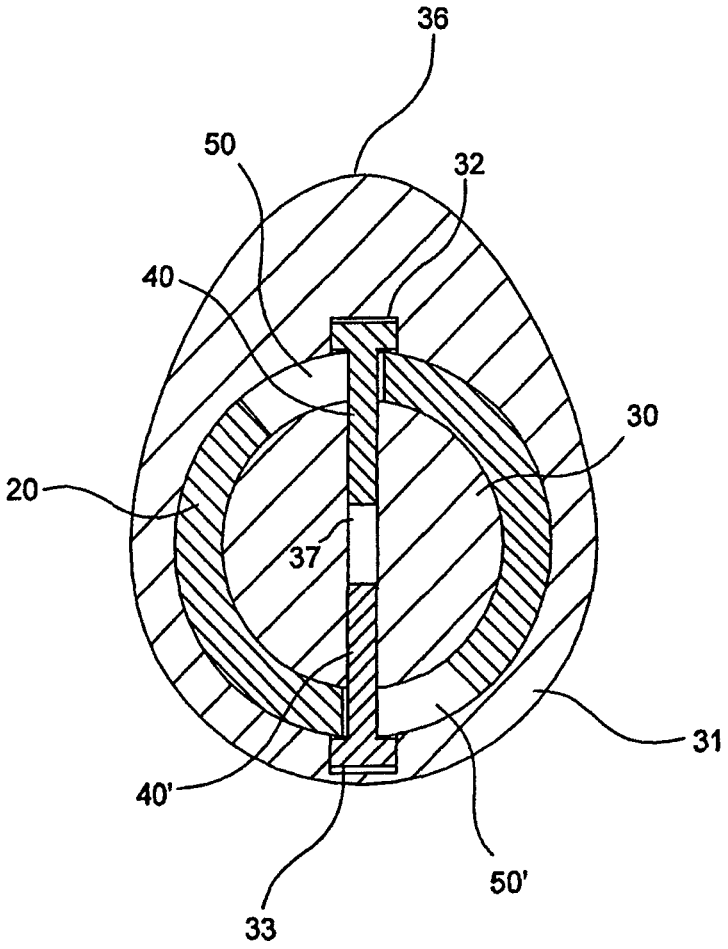
FIG. 6 shows a cross-sectional view through an exemplified embodiment of the camshaft arrangement in accordance with the invention with two connection elements.

FIG. 6 illustrates a further exemplified embodiment of the invention in which two connection elements 40 and 40' are used which are inserted into the inner shaft 30 from opposite-lying sides into a through-bore 37. In this case, the inner shaft cam element 31 has two likewise opposite-lying grooves 32 and 33 into which the head portions of the two connection elements are pushed. Two apertures 50 and 50' are again provided in the outer shaft 20, in which apertures the two connection elements can be moved with clearance when the inner shaft rotates with respect to the outer shaft. This embodiment is possible when an inner shaft cam element has sufficient hub wall thickness in the base circle region. The head portion of the connection element can protrude below the cam elevation 36 further into the material of the inner shaft cam 31 than the head portion of the opposite-lying connection element.

As an alternative to these embodiments, provision can further be made for a respective head portion to be attached to the ends of a through-going stem portion. The two head portions can be connected to the stem, for example, by screw or pin connections, or the shaft is formed as one piece with a head portion, while the opposite-lying head portion is connected to the stem after insertion of the stem into the bore of the inner shaft.

Figure 7:
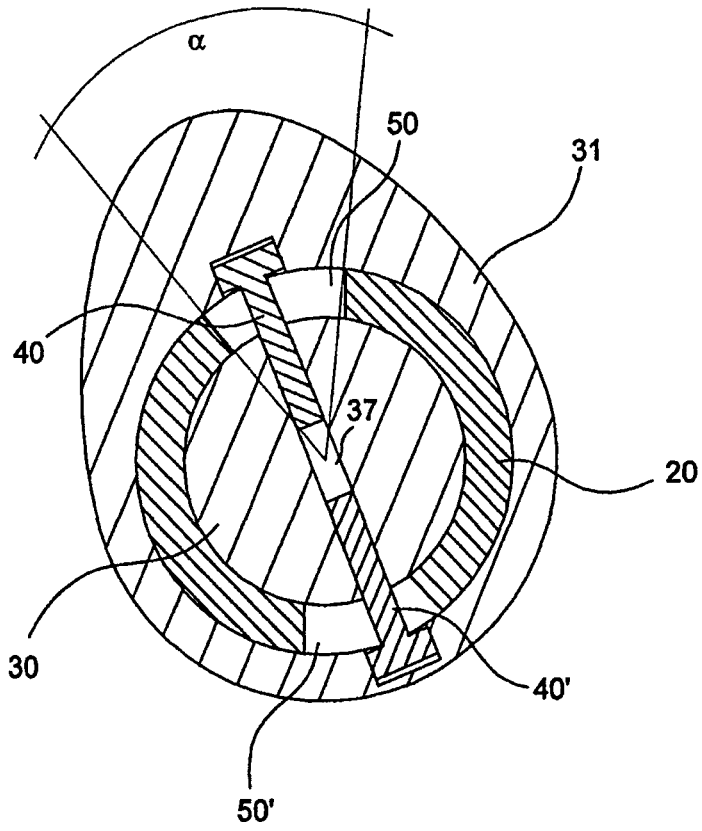
FIG. 7 shows a cross-sectional view through an exemplified embodiment of the camshaft arrangement in accordance with the invention in which a rotation of the inner shaft with respect to the outer shaft has taken place.

FIG. 7 shows a camshaft arrangement in which a rotation of the inner shaft 30 relative to the outer shaft 20 has taken place. The associated inner shaft cam 31 is carried along by the connection elements 40 and 40' so that it rotates about the outer shaft 20 to which it is attached with clearance. Between the underside of the head portion of a connection element and the outer surface of the outer shaft, a defined clearance can be present. The underside of the head portion can be adapted to the outer contour of the outer shaft 20 and be formed, for example, slightly concavely curved.

Figure 8:
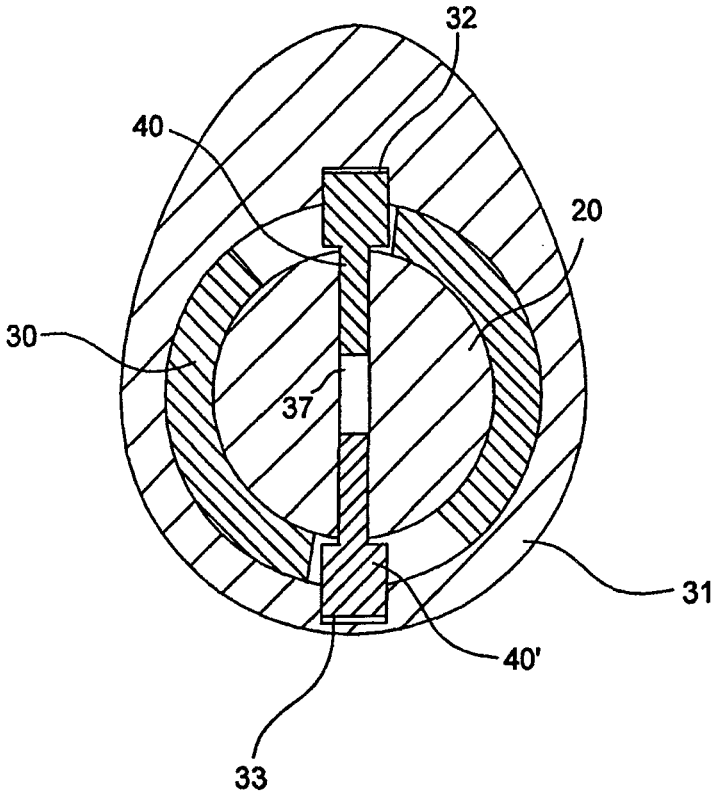
FIG. 8 shows a cross-sectional view through an exemplified embodiment of the camshaft arrangement in accordance with the invention with a region of the head portion of the connection element inside the aperture of the outer shaft.

In a further possible exemplified embodiment of the invention, which is shown by way of example in FIG. 8, the head portion 42 of a connection element 40 is not located completely outside the outer shaft but is partially disposed in the aperture 50 and 50' within the outer shaft. This embodiment has, for example, the advantage that no defined clearance has to be provided between the underside of the head portion and the outer surface of the outer shaft. The connection element 40 (and/or 40') has to be inserted into the inner shaft only so far that the groove 32 of an inner shaft cam element 31 can be joined over the region of the head portion which protrudes out of the outer shaft. This embodiment can be selected for any shape of connection element and is not limited to the embodiment illustrated in FIG. 8 with two opposite-lying connection elements. The bore 37 shown in FIG. 8 can also be formed as a one-sided or double stepped bore and the head portion can protrude partially into the stepped bore. However, this embodiment is not shown in FIG. 8.

As an alternative to the embodiments of the invention illustrated in the figures, a connection element can also be formed by a through-going connection pin with a square cross-section, the cross-sectional shape of which does not change over the length. The pin has a lower stem region which is inserted into an aperture in the inner shaft 30. The dimensions of the upper head region are selected such that the groove 32 of an inner shaft cam 31 can be pushed over the head region from the side. An interference fit is also produced between two opposite-lying inner surfaces of the groove and the corresponding side surfaces of the head region of the connection pin, which interference fit can be ensured by a suitable dimensional overlap between the groove of the inner shaft cam and the head region. In this embodiment the side surfaces of the connection element in the head region can be provided with profiling in order to improve the interference fit with the inner shaft cam element 31.

However, the formation of a connection element from a shaft and a head portion formed at a right angle thereto can be more advantageous because the shape and dimensions of the stem can be selected such that this stem can be inserted easily into an aperture in the inner shaft, while the shape and dimensions of the head portion can be adapted to the requirements for reception in the groove of an inner shaft cam. For the stem, a different shape than for the head portion of a connection element can therefore be advantageous.

Figure 9:
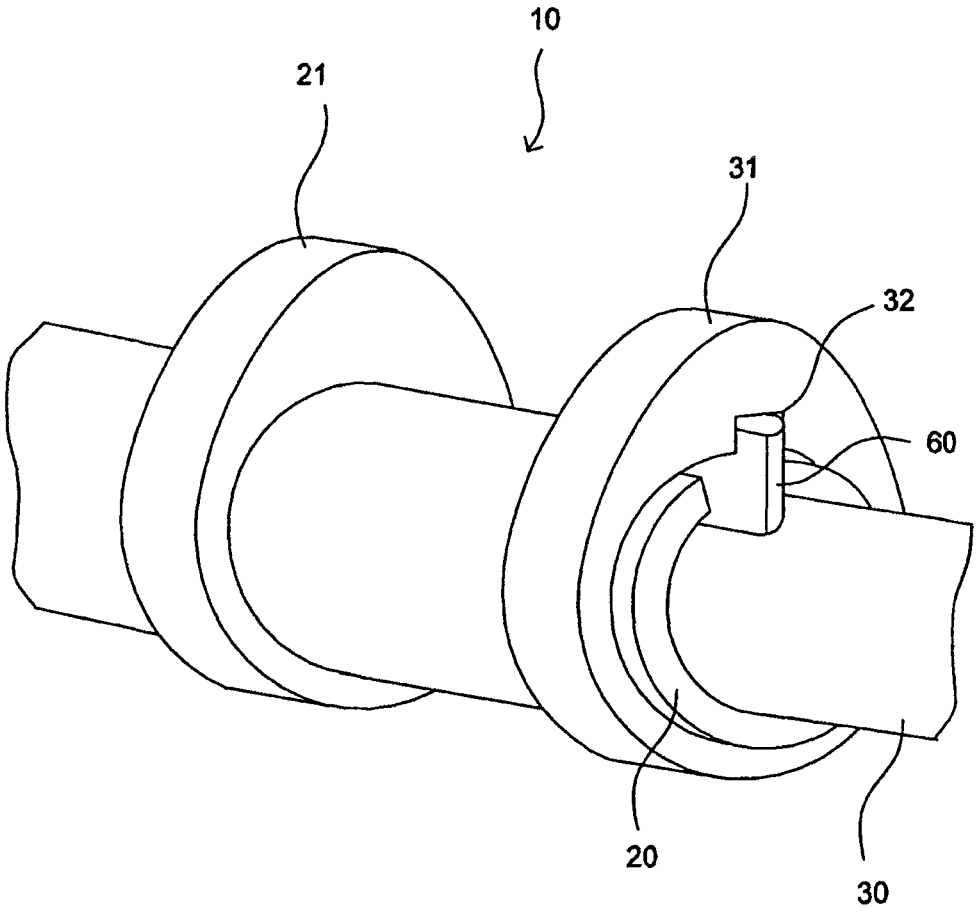
FIG. 9 shows an exemplified embodiment of the camshaft arrangement in accordance with the invention with a feather key.
Figure 10:
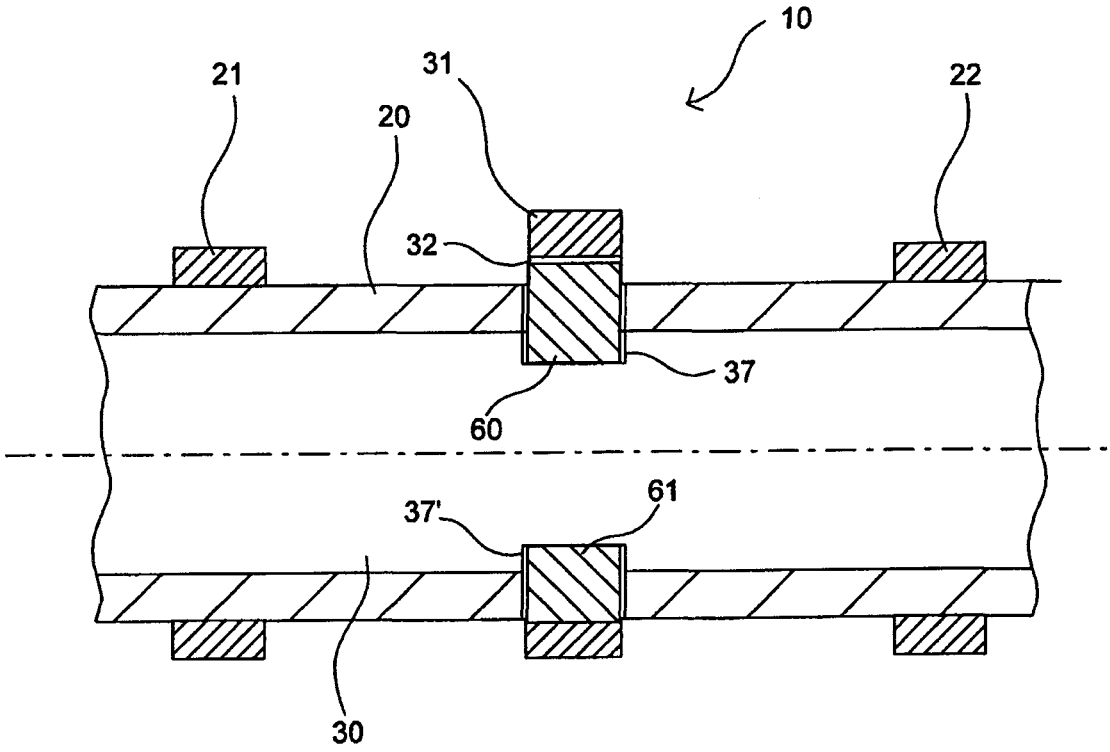
FIG. 10 shows a cross-sectional view through an exemplified embodiment of the camshaft arrangement in accordance with the invention with a feather key.

A further exemplified embodiment of the invention is shown in FIG. 9 and FIG. 10, in which a connection element is formed as a feather key 60 which is inserted into a feather key groove in the inner shaft 30. The side surfaces of the feather key 60 also lie with an interference fit against the side inner surfaces of the groove 32 in the inner shaft cam 31. The feather key 60 extends at least over the whole length of the groove 32. The side surfaces of the feather key can extend in parallel or conically with respect to each other. Furthermore, these side surfaces of the feather key 60 can be formed in a profiled manner.

In addition, on the opposite-lying side of the camshaft arrangement 10 a further feather key 61 can be provided which is inserted into a second feather key groove 37' in the inner shaft, as shown in FIG. 10. The two feather keys are formed differently so that the feather key 60 below the elevation 36 of the inner shaft cam 31 is higher than the opposite-lying feather key 61. Therefore, the groove 37' is also flatter on the opposite-lying side and the feather key 61 protrudes to a lesser extent into the material of the inner shaft cam 31.

Both in an embodiment with a feather key and also in the case of a pin-like connection element with a head portion, the aperture 32 in the inner shaft cam 31 can be provided with support points which define a radial movement of the respective connection element if such a radial movement occurs undesirably. Alternatively, these support points can also be located on the upper side of the respective connection element.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

| Reference list: | |
|---|---|
| 10 | camshaft arrangement, camshaft system |
| 20 | outer shaft |
| 21, 22 | outer shaft cam, outer shaft cam element |
| 30 | inner shaft |
| 31 | inner shaft cam, inner shaft cam element |
| 32, 33 | aperture, groove in the outer shaft |
| 34, 35 | inner surfaces groove |
| 36 | cam elevation |
| 37, 37' | receiver, bore in the inner shaft, feather key groove |
| 40, 40' | connection element |
| 41, 41' | stem, stem region |
| 42, 42' | head portion, head region |
| 43, 44 | side surfaces of a head portion, head region |
| 50, 50' | aperture in the outer shaft |
| 60, 61 | feather key |
| α | circumferential angle, adjustment angle |

The invention claimed is:

1. A camshaft arrangement for a motor vehicle engine, comprising:

a hollow outer shaft supporting a plurality of outer shaft cams, wherein the outer shaft cams are non-rotatably attached to the outer shaft; and an inner shaft disposed coaxially inside the outer shaft, wherein the hollow outer shaft and the inner shaft are disposed so as to be able to rotate with respect to each other, and wherein the inner shaft supports a plurality of inner shaft cams that are each non-rotatably attached to the inner shaft by at least one connection element, wherein the at least one connection element protrudes with clearance through an aperture in the outer shaft and is attached to one of the plurality of inner shaft cams that is rotatably mounted on the outer shaft, wherein the at least one connection element is inserted into a receiver in the inner shaft so that a portion of the connection element protrudes out of the receiver, and the protruding portion is at least partially inserted into an aperture located at a joint diameter of the one of the plurality of inner shaft cams, wherein the aperture is open at least towards an end face of the one of the plurality of inner shaft cams, and the protruding portion has at least two opposite-lying side surfaces that lie with an interference fit against two corresponding inner surfaces of the aperture of the one of the plurality of inner shaft cams.

2. The camshaft arrangement as claimed in claim 1, wherein the at least one connection element is a feather key and the receiver is formed as a feather key receiver.

3. The camshaft arrangement as claimed in claim 1, wherein the at least one connection element has a stem and a head portion, wherein the stem is inserted into the receiver in the inner shaft and the head portion is the protruding portion that is inserted at least partially into the aperture that is located at the joint diameter of the respective inner shaft cam.

4. The camshaft arrangement as claimed in claim 1, wherein the at least one connection element has a stem and a head portion, wherein the stem is inserted with an interference fit into the receiver and the head portion is at least one component of the protruding portion of the connection element.

5. The camshaft arrangement as claimed in claim 4, wherein the head portion of the at least one connection element is located completely outside the outer shaft.

6. The camshaft arrangement as claimed in claim 4, wherein the head portion is located partially within the aperture in the one of the plurality of inner shaft cams and partially in the aperture in the outer shaft.

7. The camshaft arrangement as claimed in claim 6, wherein the inner shaft has a stepped bore and the head portion protrudes partially into the stepped bore.

8. The camshaft arrangement as claimed in claim 3, wherein the stem of the at least one connection element extends through the body of the inner shaft and into a second aperture in the outer shaft.

9. The camshaft arrangement as claimed in claim 1, wherein the one of the plurality of inner shaft cams is connected to the inner shaft by two opposite-lying connection elements in such a way that a torque transfer is achieved.

10. The camshaft arrangement as claimed in claim 9, wherein stems of the two connection elements are inserted into a common receiver in the inner shaft.

11. The camshaft arrangement as claimed in claim 1, wherein the aperture extends for passage of the at least one connection element through the outer shaft over a portion of the circumference of the outer shaft in such a way that the at least one connection element and of the inner shaft are moveable relative to the outer shaft by an adjustment angle $\alpha$.

12. The camshaft arrangement as claimed in claim 3, wherein the head portion is formed at right angles to the stem portion of the at least one connection element.

13. The camshaft arrangement as claimed in claim 3, wherein the two side surfaces of the head portion and the two inner surfaces of the aperture each extend in parallel or conically with respect to each other.

14. The camshaft arrangement as claimed in claim 3, wherein the two side surfaces of the head portion or the two inner surfaces of the aperture in the inner shaft cam have a profiled surface.

15. The camshaft arrangement as claimed in claim 1, wherein the aperture is formed as a groove extending over a whole width of the inner shaft cam.

16. The camshaft arrangement as claimed in claim 1, wherein the aperture is located centrally below the elevation of the one of the plurality of inner shaft cams.

17. The camshaft arrangement as claimed in claim 1, wherein the connection element is a single-piece component.

* * * * *